United States Patent [19]

Thery

[11] 4,258,670

[45] Mar. 31, 1981

[54] METHOD FOR FEEDING A COMBUSTION CHAMBER OF A TWO-STROKE ENGINE OF THE CONTROLLED IGNITION TYPE AND ENGINE APPLYING SAID METHOD

[76] Inventor: Georges Thery, 6, Place du General Leclerc, 93380 Pierrefitte, France, 93380

[21] Appl. No.: 135,092

[22] Filed: Mar. 28, 1980

Related U.S. Application Data

[63] Continuation of Ser. No. 844,378, Oct. 21, 1977, abandoned.

[51] Int. Cl.[3] ..... F02B 33/04

[52] U.S. Cl. ..... 123/73 B; 123/73 V; 123/73 DA; 123/873 AF

[58] Field of Search ..... 123/72, 73 B, 73 DA, 123/73 V, 73 R, 73 A, 73 AF

[56] References Cited

U.S. PATENT DOCUMENTS

| | | | |
|---|---|---|---|
| 1,105,882 | 8/1914 | Crawford | 123/73 DA |
| 1,750,918 | 3/1930 | Barletta | 123/73 B |
| 2,055,026 | 9/1936 | Cook | 123/73 B |
| 2,388,331 | 11/1945 | Kincannon | 123/73 DA |
| 2,833,256 | 5/1958 | Hayward | 123/73 DA |
| 2,946,324 | 7/1960 | Casini | 123/73 DA |
| 3,687,118 | 8/1972 | Nomura | 123/73 B |
| 3,753,425 | 8/1973 | Hooper | 123/73 DA |
| 4,062,331 | 12/1977 | Boyeson | 123/73 B |
| 4,075,985 | 2/1978 | Lwai | 123/73 B |

*Primary Examiner*—Ira S. Lazarus

*Attorney, Agent, or Firm*—Lerner, David, Littenberg & Samuel

[57] ABSTRACT

The present invention relates to a method for feeding the combustion chamber of a two-stroke engine, according to which the constituents of the combustible mixture are admitted into the combustion chamber via two intake devices at the bottom of the cylinder. Air without fuel is admitted through two ports, symmetrically disposed with respect to the vertical plane containing the axis of the exhaust port, directed towards the wall opposite the exhaust; the petrol-and-air mixture is admitted through at least one port remotest from the exhaust so that the stream of carburetted air is directed towards the cylinder head, the carburetted mixture thus being maintained towards the wall opposite the exhaust by the two streams of air without fuel until the ports are closed. The invention finds particular application in the field of automobile construction.

25 Claims, 7 Drawing Figures

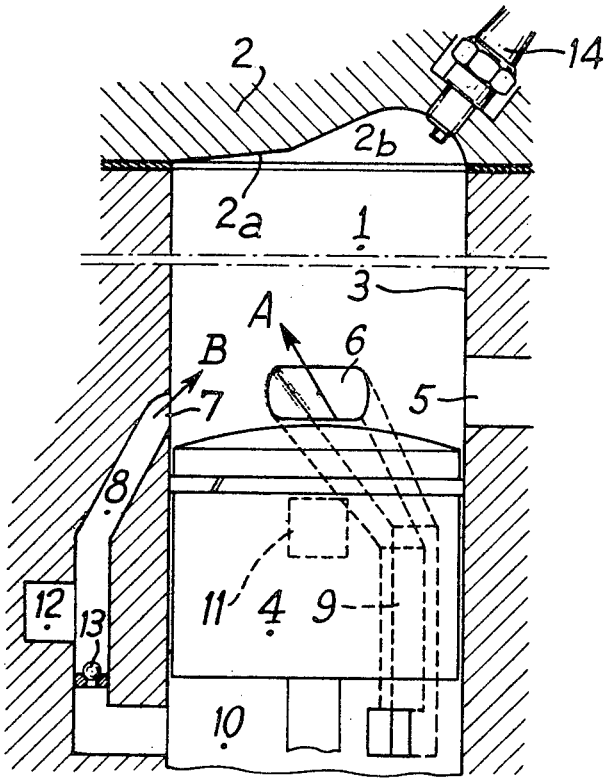
FIG. 1A
FIG. 1D
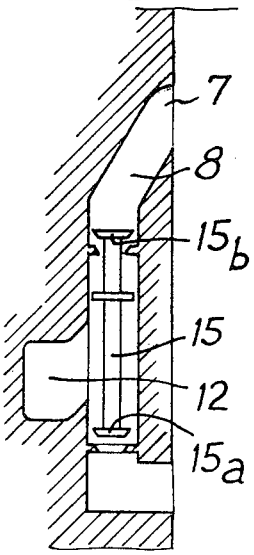
FIG. 1B
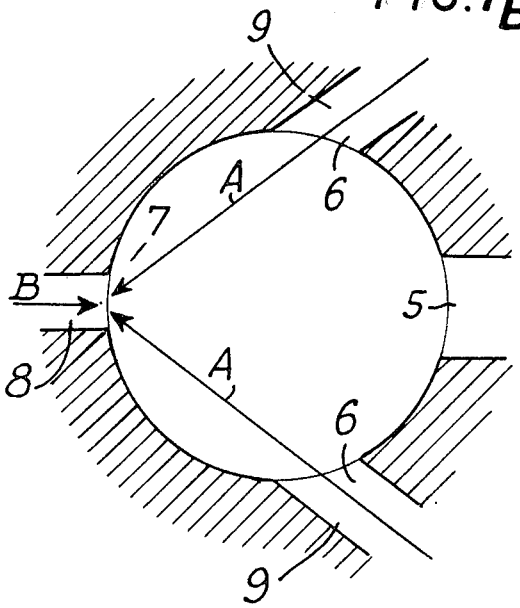

METHOD FOR FEEDING A COMBUSTION CHAMBER OF A TWO-STROKE ENGINE OF THE CONTROLLED IGNITION TYPE AND ENGINE APPLYING SAID METHOD

This is a continuation of application Ser. No. 844,378, filed Oct. 21, 1977 now abandoned.

BACKGROUND OF THE INVENTION

The present invention relates to a two-stroke internal combustion engine of the double intake type to avoid the losses of carburetted mixture through the exhaust, with a view to reducing pollution and fuel consumption.

SUMMARY OF THE PRIOR ART

The present two-stroke engine has the double drawback of having a high specific consumption and of being a considerable source of pollution. These drawbacks are mainly caused by the losses of unburnt fuel through the exhaust during scavenging.

The use of direct injection of petrol has often appeared as being particularly interesting for this type of engine. The injection is expensive, particularly in the form of direct injection. The field of two-stroke engines of the controlled ignition type is the one where direct injection appears technically to be the most desirable and, economically, the most difficult to apply. In fact, the engines are mainly of small and average cubic capacity for which it would be necessary to make very small and very accurate controls and for which the low cost price is a determining factor, the cost of a four-stroke engine of equivalent power being the limit not to be exceeded.

In an attempt to solve the problem raised by these engines, a double intake of the combustible mixture has been recommended, constituted by two valves at the top of the cylinder, one of the valves allowing a rich, or very rich mixture to enter, the other valve allowing a lean mixture, or pure air, to enter. This solution is not entirely satisfactory since there is interpenetration of the intake streams. Scavenging being in equicurrent, the path traversed is shorter and the reflection of these streams on the piston head accentuates their mixture. Carburetted mixture continues to be drawn through the exhaust port. For this type of motor, it has also be thought to create a double intake at the top and bottom of the cylinder, the intake of rich mixture being made at the top of the cylinder through an orifice with controlled opening and closure. This method is efficient but reduces the advantage of simplicity of the two-stroke engine with ports.

It is an object of the present invention to remedy these drawbacks by proposing a method of intake for a two-stroke engine carried out exclusively by ports, and two-stroke engines applying this method. The invention relates to a method and engines enabling the pollution and consumption of this type of engine to be very substantially reduced, in economical manner, and also enabling a higher specific power to be obtained, for the same consumption, than that of presently known engines.

SUMMARY OF THE INVENTION

To this end, the invention relates to a method for feeding the combustion chamber of a two-stroke reciprocating engine with controlled ignition, comprising at least one piston, a cylinder, a cylinder head defining said chamber and inlet and exhaust ports at the bottom of the cylinder, according to which the constituents of the combustible mixture are admitted into the chamber through two intake devices opening in the bottom of the cylinder, the one nearer the exhaust comprising two ports, the one more remote from the exhaust having at least one port. According to this method, air without fuel is admitted through the device nearer the exhaust, opening through two ports, symmetrically disposed with respect to the vertical plane of section of the exhaust port and the axes of which, intersecting inside the cylinder, are directed towards the wall opposite the exhaust, whilst the petrol-and-air mixture is admitted through the device more remote from the exhaust, comprising at least one port and the stream of which is directed towards the top of the cylinder.

In a preferred variant embodiment of this method, the cylinder head comprises a cavity for promoting the accumulation of mixture in said cavity, where the ignition member is located, and a flatter portion which, at top dead centre, creates the compression of the subjacent gaseous volume, and a turbulence towards this cavity. Said cavity advantageously opens on the combustion chamber along an oblong opening whose largest dimensions are contained in the median plane passing through the axis of the exhaust port.

Furthermore, the exhaust pipe is provided with an obturator intended to allow the closure of the exhaust at about bottom dead centre.

The invention also relates to an engine applying the above-mentioned method.

In a first embodiment, the two intake devices are connected to the same excess pressure system. Only the or each pipe most remote from the exhaust, which ensures intake of the mixture, is provided with a fuel-feed device, located downstream of the excess pressure system.

In the case of the excess pressure being solely effected by the crankcase acting as pump, and where the fuel feed downstream of said crankcase is effected by carburation or continuous indirect injection, known means are adopted to avoid a suction of the fuel in the crankcase-pump when the piston rises again; clack-valve, non-return valve or transfer port in the skirt of the piston or rotary distributor.

In other embodiments, one of the intake devices is connected to a first excess pressure system, provided with means for regulating its flow as a function of the engine speed; the second device then issues from another excess pressure system.

Finally, in a further embodiment, the cavity of the cylinder head intended to ensure the concentration of the mixture comprises two sparking plugs, the axes of which are located in the vertical median plane of the cavity and in the direction of the turbulence produced at top dead centre by the flattest part of the cylinder head.

BRIEF DESCRIPTION OF THE DRAWINGS

FIGS. 1A and 1B schematically illustrate a first embodiment of an engine according to the invention.

FIGS. 1C and 1D are schematic views of variant details of this first embodiment.

DESCRIPTION OF THE PREFERRED EMBODIMENT

Figure 2:
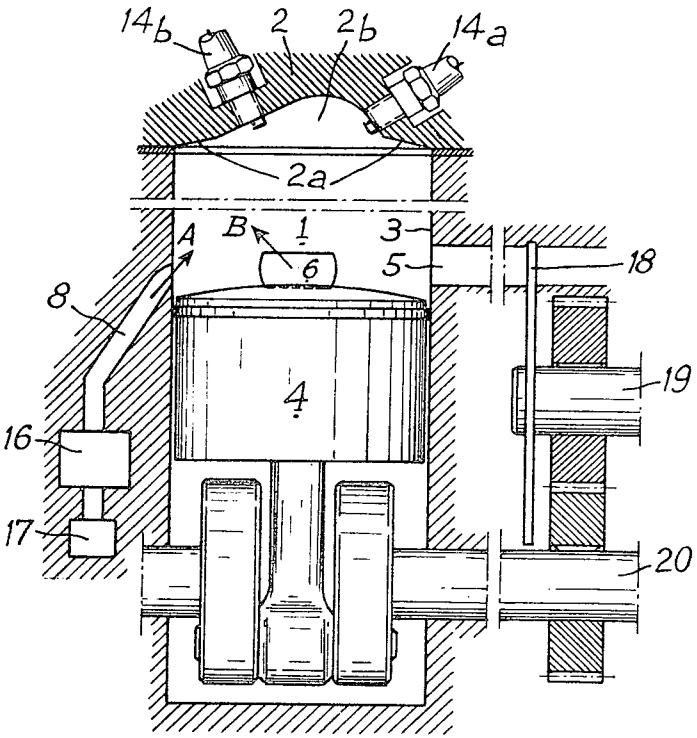
FIG. 2 is a diagram of a variant of this embodiment.

Referring now to the drawings, FIGS. 1A and 1B, show a combustion chamber 1 of an engine defined by a cylinder head 2, cylinder 3 and a piston 4 shown at bottom dead centre. This chamber 1 comprises, in known manner, an exhaust port 5 and a double intake system. This system comprises a first device constituted by two ports 6—only one of which is visible in FIG. 1A—symmetrical with respect to the vertical plane containing the exhaust port 5 and a second device constituted by a port 7 opening in the chamber 1 opposite the exhaust port 5.

These ports 6 and 7 are respectively connected to inlet pipes 8 and 9 issuing from a precompression system, known per se, which, in the case of the Figure, is a crankcase acting as pump 10, in which the lower face of the piston serves as member for forcing air drawn in the crankcase through port 11, through the transfer pipes 8 and 9.

On the pipe 8 opening in the combustion chamber 1 via port 7 opposite the exhaust 5, there has been arranged a fuel feed device 12, particularly a carburettor. Said latter being located downstream of the excess pressure system is provided in known manner with a device for connection with this latter system in order to be subjected to the pressure prevailing therein. Finally, the mixture inlet pipe 8 comprises, in its low part, between the fuel-feed device 12 and the inlet orifice of the pipe, a non-return valve 13. The exhaust pipe may be provided with an obturator (not shown).

With a feed by carburation or continuous indirect injection, placed on the pipe 8, located downstream of the crankcase-pump, one must avoid creating a partial vacuum in this pipe when the piston 4 rises again. To avoid this, other devices (not shown) may be used, apart from the non-return valve mentioned: non-return valve, port in the skirt of the piston ensuring the connection of the transfer pipe only during the time of the transfer towards the cylinder, rotary distributor disposed so as to establish a selective communication of the crankcase-pump with the atmosphere during the rise of the piston and with the mixture inlet pipe near the bottom dead centre.

Figure 1C:
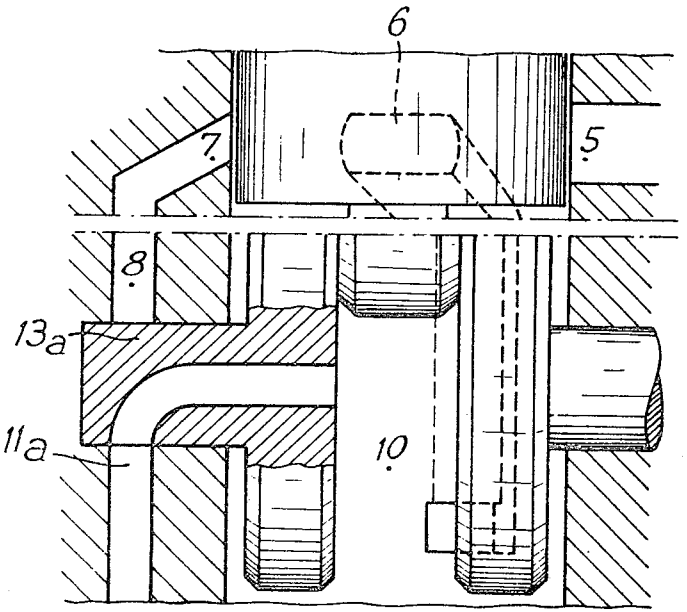

FIG. 1C illustrates, on this subject, a rotary distributor 13*a* adapted to establish a communication between the precompression crankcase 10 and the pipe 8 around the bottom dead centre and a communication between said crankcase and a conduit 11*a* opening to the atmosphere when the piston rises again.

Finally, it will be noted that the cylinder head 2 comprises a slightly concave portion 2*a*, whose shape complements the convex shape of the piston head 4 and a portion of more accentuated concavity forming a cavity 2*b* in which the ignition member 14 is placed, in the present case a sparking plug.

The combustion of the mixture contained in the chamber at top dead centre by the sparking plug 14 pushes the piston back which firstly releases the exhaust port 5, this allowing the beginning of exhaust, then the inlet ports 6 and 7.

FIGS. 1A and 1B, said latter being a schematic horizontal section of FIG. 1A at the level of the ports 5, 6 and 7, show how the double intake of air without fuel (arrow A) and of carburetted mixture (arrow B) is effected. The air is admitted through the two ports 6 closest to the exhaust, located symmetrically with respect thereto and of which the axes directed towards the wall opposite the exhaust intersect inside the cylinder. In this way, they introduce a screen of air which ensures the scavenging, contributes to filling and isolates from the exhaust the mixture admitted through the port 7 opposite the exhaust.

FIG. 1A shows that the mixture directed towards the top of the chamber by the orientation of the pipe 8 (arrow B) and the pressure, and the direction of the air introduced (arrow A), is maintained isolated from the exhaust by this screen of air. In addition, the mixture is confined in portion 2*b* of the cylinder head by the dynamic effect of the gaseous currents produced by the pressure of intake and the partial vacuum of exhaust. Being given that, due to the invention, the direction of transfer is located in the plane of FIG. 1A (plane passing through ports 5 and 7), it is advantageous to provide a cavity 2*b* whose opening on the combustion chamber 1 is large in dimension in the direction of said plane. In the direction perpendicular to this plane, the opening of the cavity 2*b* may be more reduced, this moreover enabling a large surface of compression of the combustible mixture to be obtained and a considerable turbulence in said cavity to be produced. There can therefore not be any loss of mixture through the exhaust 5 and the rich mixture is concentrated in the cavity 2*b* of the cylinder head 2 where the sparking plug 14 is located.

It is known from VIOLET's studies that the scavenging is practically terminated around bottom dead centre. The obturator, known per se, which may be placed in the exhaust, will close, around the bottom dead centre, the exhaust pipe up to the moment of closure of the corresponding port by the piston rising, with a view to avoiding losses of air through the exhaust and to improve filling.

At the beginning of opening of the ports, there may be a delivery of burnt gases in the mixture inlet pipe, in this presenting the risk of disturbing the carburation. To avoid this risk, it has been provided to delay the opening of the mixture inlet port with respect to the opening of the air inlet ports, so that, at the beginning of intake of the mixture, the delivery pressure of the air by the crankcase-pump in the transfer pipe 8 has become higher than the pressure prevailing in the combustion chamber. This delay may be ensured simply by acting on the relative geometry (height) of the various inlet ports, or by having positioned an automatic valve opening the transfer conduit only when the lack of balance of the pressures is favourable to this transfer. FIG. 1D illustrates a particular embodiment of this valve 15*b* closing conduit 8 downstream of the carburation device 12 associated in a two-headed valve with the valve 15*a* fulfilling the role of non-return valve 13 of FIG. 1A.

It is obvious that, although this Figure shows a system of precompression using a crankcase acting as pump, it may, without departing from the scope of the invention, be conceived that the conduit issues from an auxiliary precompression system actuated by the rotation of the engine.

FIG. 2 shows an engine in which the two inlet devices are connected to two different excess pressure systems. Certain elements which have already been described with reference to the preceding Figures are shown again, with the same references.

The mixture inlet pipe 8 is equipped with an excess pressure system 16, upstream of which is disposed a fuel-feed system 17, for example a carburettor. The inlet ports for air without fuel, such as 6, are connected to a pipe (not shown) which may for example issue, as in the preceding Figures, from a precompression crankcase.

This Figure also schematically shows a device for obturating the exhaust 5 constituted by a rotary disc 18 driven by a shaft 19 rotating as a function of the rotation of the drive shaft 20.

In a variant (not shown), this exhaust obturating device could be constituted by an automatic device employing a valve.

The presence of a supercharger for supplying carburetted mixture to the chamber allows a very substantial increase in the rate of filling and therefore an increase in the specific power. It is to be noted, in this case, that the supercharger device must be such that it does not provoke, as a function of the speed of rotation, too high an increase in torque. This is the case in particular of the excess pressure devices with double-acting piston or volumetric devices with bosses. The engines thus equipped will be high performance engines. If, on the other hand, it is desired to produce a normal engine, i.e. to conserve a rate of filling of the same order of magnitude as that usually employed, centrifugal superchargers may be used which offer the advantage of being much less expensive and much simpler. A supercharger will then be chosen which ensures an excess pressure of less than 25% and of which the flow at low speed will be less than the stream of air without fuel admitted in the combustion chamber. However, it will be necessary to calculate the exhaust pipe so as to provoke a favourable reflection of the pressure wave at slow speed. Such an adjustment of the two intakes presents the advantage of displacing the maximum torque of the engine at a higher engine speed. In other words, at high speeds of rotation of the engine, a higher torque is obtained than that which is obtained by an ordinary two-stroke engine without supercharger. The favourable range of power as a function of the engine speed is therefore much more extensive and the vehicle provided with this engine is much more versatile. Finally, it is to be noted that, at high speed, is may happen that the combustible mixture enclosed in the combustion chamber is too rich. This drawback may be overcome by various devices: mention will be made particularly of the opening of several air intakes triggered by partial vacuum upstream of the throttle, the installation of a regulating carburettor or of an obturator manoeuvred as a function of the engine speed, or an electrical or mechanical device for driving the supercharger the power variation of which will be controlled in manner less than proportional to the increase of the engine speed.

In the particular case of engines capable of functioning at constant speed, a carburetted mixture feed may be envisaged by simple drawing of said latter in the cylinder, resulting on the one hand from the opening of the exhaust port and, on the other hand, from the effect of suction due to the intake of the air without fuel under pressure.

Figure 3A:
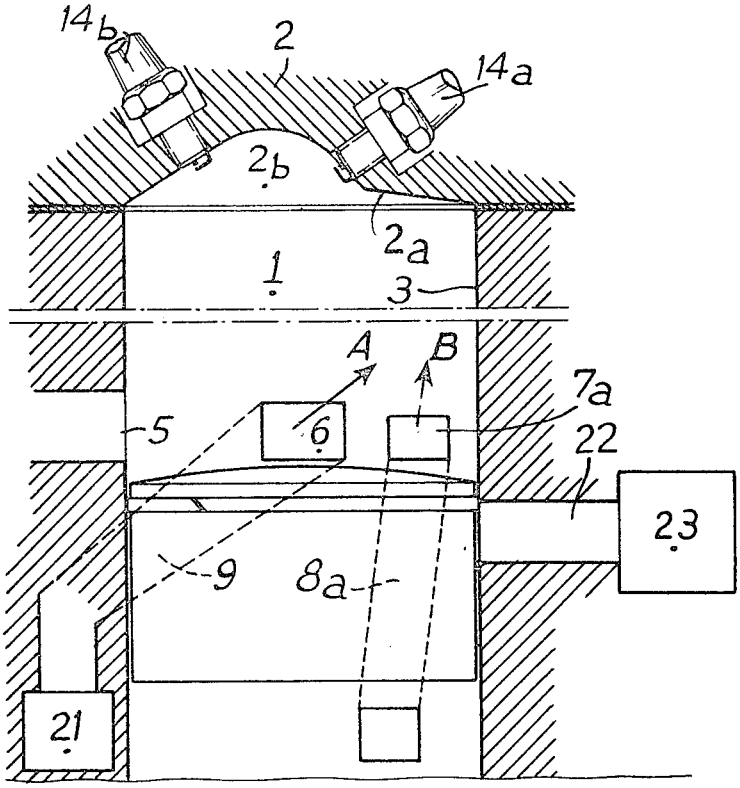
FIGS. 3A and 3B schematically illustrate a second embodiment of the invention.
Figure 3B:
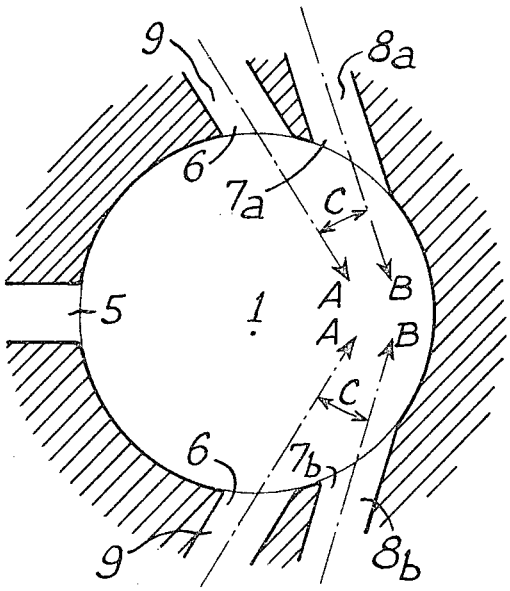

In FIGS. 3A and 3B, the pipes 9 for intake of air through ports 6 are connected to an excess pressure device 21 of the type as described previously. The axes of the ports **7*a* and 7*b* are directed towards the wall opposite the exhaust and form with the axes of the air inlet ports 6 angles C smaller than 90°. These pipes 8*a* and 8*b* are connected to the crankcase-pump, the inlet 22 of which is provided, in conventional manner, with a fuel feed device 23**. This arrangement enables a "petroil" lubrication to be effected. In the case of the non-carburetted air supply supercharger being of the centrifugal type, to avoid too great an increase of its flow as a function of the increase of its speed of rotation, a member may be provided for obturating the air inlet pipe in the supercharger controlled by its speed of rotation or said supercharger may be driven by means of suitable mechanical or electrical devices, whilst, furthermore, ensuring a regulation of the carburation so that the richness of the carburetted mixture is increased as a function of the increase in speed.

It is to be noted that, in these Figures, the cavity **2*b* where the carburetted mixture is concentrated, comprises two sparking plugs 14*a* and 14*b* the axes of which are located in the vertical median plane of this cavity. One, 14*a*, of the two sparking plugs is close to the junction between the flattest portion 2*a* of the cylinder head and the cavity 2*b*. In this way, the turbulence provoked by the beginning of the combustion (sparking plug 14*a***) and the end of compression at dead centre of the volume located under the flattest part of the cylinder head, enables a projection of partially burnt gases to be obtained towards the second sparking plug, which are reactivated in a second ignition zone much larger than the first.

The advantages of the invention correspond to those obtained by a direct injection of petrol but much less expensively, much more simply, and with less difficult repairs. When it has to different feed systems, the invention offers the supplementary specific advantage of enabling the rate of filling to be increased.

Apart from their advantages of economy and increase in power, the engines forming the subject matter of the invention comprise devices enabling an overall lean mixture to be used, whilst respecting all the objectives of reducing pollution.

The most simple and most efficient means of reducing the proportion of carbon monoxide and nitrogen oxide is to use an overall lean mixture, due to the use of a heterogeneous mixture, comprising a rich portion in the zone adjacent the sparking plug, so as to have a rapid beginning of ignition. If this result can be obtained in good conditions fully loaded, under reduced load, the speed of combustion at the end of combustion is too slow and there is an increase in the unburnt products.

The following devices: cavity where the rich mixture concentrates, turbulence by compression of part of the volume of the chamber and double ignition in the axis of the turbulence, enable an excellent combustion to be made in all the operational conditions of the engine.

The rich mixture concentration cavity in which the sparking plug is located enables a rapid beginning of combustion to be obtained.

At top dead centre, the turbulence provoked by the compression of the adjacent zone of the flat portion avoids having too slow a final phase, which is the main danger of the combustion of the heterogeneous mixtures. Moreover, this turbulence also contributes to rendering the beginning of combustion moe rapid. Combustion is therefore constantly accelerated.

With this device, the mixture is heterogeneous at the beginning of combustion, enabling a rich mixture to be obtained near the sparking plug and a rapid initial combustion phase, and it is rendered homogeneous for the end of combustion by the turbulence provoked at top dead centre.

Finally, the device with tubulence and two sparking plugs placed in the axis of this turbulence has for its effect to create a second, larger zone of combustion than the first zone, without the reduction of the load being able to reduce the efficiency of this second zone. In fact, the increase in the combustion volume of this second zone is due to the products of decomposition coming from the first zone. These latter are provoked by an incomplete combustion. If the combustion of the first zone is slower, the proportion of decomposition products increases, promoting the combustion in the second zone. The reduction of the load increases the ratio between the volume of the second zone and that of the first combustion zone. One is therefore sure of a very considerable combustion under low load. Furthermore, the constitution of a rich mixture near the sparking plug due to the heterogeneity of the mixture ensures a regular combustion at all speeds and enables the irregularity of fonctioning of the two-stroke engines at low speed, caused by the unburnt products, to be avoided.

The invention finds advantageous application in the field of the construction of two-stroke internal combustion engines.

What is claimed is:

1. A reciprocating two-stroke engine of the controlled-ignition type including a combustion chamber defined by a piston, a cylinder, and a cylinder head whereby said piston reciprocates within said cylinder between a compression stroke as said piston moves towards said cylinder head and an intake stroke as said piston moves away from said cylinder head, said combustion chamber comprising a pair of air inlet ports, a fuel and air mixture inlet port, and an exhaust port, said air inlet ports, said fuel and air mixture inlet port, and said exhaust port being displaced from said cylinder head in said cylinder, said pair of air inlet ports being symmetrically disposed in said combustion chamber with respect to said exhaust port and being oriented so that air exiting therefrom is directed towards the wall of said cylinder opposite said exhaust port, a pair of air intake conduits for feeding air without fuel into said combustion chamber through said pair of air inlet ports, a fuel and air mixture intake conduit for feeding a fuel and air mixture into said combustion chamber through said fuel and air mixture inlet port, connecting means for connecting said air intake conduits and said fuel and air mixture intake conduit with at least one excess pressure device so as to feed said air and said fuel and air mixture into said combustion chamber under an excess pressure condition throughout said entire intake stroke of said piston in said cylinder, and fuel supply means for supplying fuel to said fuel and air mixture intake conduit.

2. The reciprocating two-stroke engine of claim 1 wherein said fuel supply means comprises a carburetor.

3. The reciprocating two-stroke engine of claim 1 wherein said pair of air inlet ports are located closer to said exhaust port than is said fuel and air mixture inlet port, and wherein said fuel and air mixture inlet port is oriented so that said fuel and air mixture exiting therefrom is directed towards said cylinder head, whereby said air fed into said combustion chamber through said pair of air inlet ports assists in preventing said fuel and air mixture from exiting said combustion chamber through said exhaust port.

4. The reciprocating two-stroke engine of claim 1 or 3 wherein said combustion chamber includes a cavity at the top thereof formed by said cylinder head for accumulating said fuel and air mixture when said piston is at the top dead center of its compression stroke, and including an ignition member located in said cavity, said cavity having a configuration such that its largest dimension is located in the median plane passing through said exhaust port, and wherein the periphery of said cavity comprises a flattened portion of said cylinder head for compressing said fuel and air mixture and creating a turbulence within said cavity.

5. The reciprocating two-stroke engine of claim 1 or 3 wherein said at least one excess pressure device comprises a crankcase-pump formed by the bottom of said piston.

6. The reciprocating two-stroke engine of claim 1 or 3 wherein both said air intake conduits and said fuel and air mixture intake conduit are connected to a single excess pressure device.

7. The reciprocating two-stroke engine of claim 6 wherein said single excess pressure device comprises a crankcase-pump formed by the bottom of said piston.

8. The reciprocating two-stroke engine of claim 7 wherein said crankcase-pump includes a crankcase air port by which air is supplied to said crankcase-pump as said piston is in said compression stroke.

9. The reciprocating two-stroke engine of claim 7 or 8 including crankcase-pump valve means for preventing return flow from said fuel and air mixture intake conduit to said crankcase-pump.

10. The reciprocating two-stroke engine of claim 9 including inlet port valve means for preventing return flow from said fuel and air mixture inlet port to said point in said fuel and air mixture intake conduit where said fuel is supplied for said fuel supply means.

11. The reciprocating two-stroke enginge of claim 10 wherein said crankcase-pump valve means and said inlet port valve means are connected together as the heads of a single automatic valve.

12. The reciprocating two-stroke engine of claim 10 or 11 wherein said fuel supply means comprises a carburetor located between said fuel and air mixture inlet port and said connecting means.

13. The reciprocating two-stroke engine of claim 12 wherein said crankcase-pump valve means is located between said carburetor and said connecting means.

14. The reciprocating two-stroke engine of claim 6 wherein said connecting means for connecting said fuel and air mixture intake conduit with said crankcase-pump comprises a rotary distributor for connecting said fuel and air mixture intake conduit with said crankcase-pump only during said intake stroke of said piston.

15. The reciprocating two-stroke engine of claim 14 including atmosphere conduit means for connecting said crankcase-pump with the atmosphere through said rotary distributor only during said compression stroke of said cylinder.

16. The reciprocating two-stroke engine of claim 1 or 3 wherein said at least one excess pressure device comprises a first excess pressure device connected to said air intake conduits, and including a second excess pressure device connected to said fuel and air mixture intake conduit.

17. The reciprocating two-stroke engine of claim 16 wherein said first excess pressure device comprises a crankcase-pump and wherein said second excess pressure device comprises a supercharger.

18. The reciprocating two-stroke engine of claim 16 wherein said first excess pressure device comprises a supercharger and said second excess pressure device comprises a cránkcase-pump.

19. The reciprocating two-stroke engine of claim 17 wherein said supercharger is located in said fuel and air mixture intake conduit between said point in said fuel and air mixture intake conduit where said fuel is supplied from said fuel supply means and said fuel and air mixture inlet port, and including regulating means for regulating the flow of said supercharger as a function of the speed of said engine.

20. The reciprocating two-stroke engine of claim 18 wherein said fuel supply means supplies fuel to said crankcase-pump, and including regulating means for regulating the flow of said supercharger as a function of the speed of said engine.

21. The reciprocating two-stroke engine of claim 1 or 3 including an exhaust obturator for closing said exhaust port during said compression stroke of said piston.

22. The reciprocating two-stroke engine of claim 1 or 3 wherein said combustion chamber includes a cavity at the top thereof formed by said cylinder head for accumulating said fuel and air mixture when said piston is at the top dead center of its compression stroke, and including two ignition members located in said cavity, said two ignition members being located in the median verticle plane of said cavity.

23. The reciprocating two-stroke engine of claim 22 wherein said cavity has a configuration such that its largest dimension is located in the median plane passing through said exhaust port, wherein the periphery of said cavity comprises a flattened portion of said cylinder head for compressing said fuel and air mixture and creating a turbulence with said cavity, and wherein one of said two ignition members is located in said cavity at said flattened position so as to accelerate the speed of combustion and eliminate the risk of producing unburned products therein.

24. The reciprocating two-stroke engine of claim 3 including a pair of fuel and air mixture inlet ports symmetrically disposed in said combustion chamber with respect to a vertical plane passing through the axis of said exhaust port.

25. The reciprocating two-stroke engine of claim 24 wherein said pair of fuel and air mixture inlet ports are connected to a single fuel and air mixture intake conduit.

* * * * *